United States Patent [19]

Bouwens et al.

[11] Patent Number: 4,664,368

[45] Date of Patent: May 12, 1987

[54] DEVICE FOR COLLECTING SHEETS

[75] Inventors: Jan M. M. Bouwens, Kessel; Ferdinand M. H. F. Hooghiemstra, Venlo; Leonardus Van Ruiten, Tegelen, all of Netherlands

[73] Assignee: Oce-Nederland B.V., Venlo, Netherlands

[21] Appl. No.: 833,852

[22] Filed: Feb. 26, 1986

[30] Foreign Application Priority Data

Feb. 27, 1985 [NL] Netherlands ..... 8500545

[51] Int. Cl.[4] ..... B65H 31/20

[52] U.S. Cl. ..... 271/209; 271/224

[58] Field of Search ..... 271/188, 207, 209, 220, 271/223, 224; 414/35, 90

[56] References Cited

U.S. PATENT DOCUMENTS 1,750,396 3/1930 Evans ..... 271/188

4,361,319 11/1982 Ikeda ..... 271/209

*Primary Examiner*—Richard A. Schacher

*Attorney, Agent, or Firm*—Reed Smith Shaw & McClay

[57] ABSTRACT

A device for collecting sheets comprising a collecting tray and a conveyor roller for feeding sheets into the tray. The collecting tray comprises a baseplate having a distance between abutment surfaces which corresponds to a dimension of the sheets to be collected, preferably the length. The middle part of the baseplate is higher than the side parts. An abutment strip which contacts and stops the leading edge of a sheet fed into the tray is connected to an edge of the baseplate and has a surface which is cylindrically curved, the centerline of which coincides with the centerline of the conveyor roller. A wall plate is connected to the opposite edge of the baseplate and also has a cylindrically curved abutment surface, the centerline of which coincides with the line of intersection between the baseplate and the abutment strip.

19 Claims, 4 Drawing Figures

DEVICE FOR COLLECTING SHEETS

BACKGROUND OF THE INVENTION

1. Field of the Invention

The present invention relates to a device for collecting sheets such as those typically found in a copy machine.

2. Description of the Prior Art

U.S. Pat. No. 3,840,222 describes a device for collecting sheets with a collecting tray formed by a completely flat baseplate and a completely flat wall plate which adjoin one another at right angles and a conveyor roller which feeds sheets over the wall plate into the collecting tray. Two attractive advantages of this device in which the adjoining edge forms the lowest point of the baseplate are that when the device is disposed on the top of a sheet processing machine, such as a copying machine: (1) a relatively short feed path is required between the top of the machine and the conveyor roller at the collecting tray, and (2) the space between the collecting tray and the top of the machine is readily accessible for accommodating and reaching other facilities of the machine.

There are disadvantages, however, with this device. For example, when a sheet if fed into this collecting tray at relatively high speed, the sheet may stop on the baseplate in a position in which the sheet is at some distance from the wall plate and/or is skewed with respect to the wall plate. This incorrect positioning may occur particularly if lightweight and smooth sheets are deposited on a baseplate which is only slightly upwardly sloping or is downwardly sloping. Moreover, the last have landed correctly in the collecting tray can readily be displaced from their proper position by a subsequent sheet sliding over them as it is fed into the collecting tray.

The final position of a sheet is affected by the extent to which the sheet is slowed down in the collecting tray by sliding over the baseplate or sheets lying thereon. This slowing down is controlled by the angle of inclination of the baseplate, by the coefficient of friction between a sheet and the baseplate or between sheets relative to one another and by the weight of a sheet.

A disadvantage with a slightly upwardly sloping baseplate, such as described in U.S. Pat. No. 3,840,222, is that after a sheet has stopped in an incorrect position on the baseplate, the sheet cannot readily slide back into contact with the wall plate. This is particularly the case with heavy and stiff sheets which can readily jam on the baseplate. The object of the invention, therefore, is to provide a device without the above-mentioned disadvantages.

U.S. Pats. Nos. 3,907,128 and 4,380,332 both describe a tray particularly suitable for stacking rigid sheets such as glass sheets and die-cut blanks. Both of these trays are provided with a strip to which the leading edge of a sheet reaching the stacking position abuts for rebounding towards an abutment strip for the trailing edge. Thereafter, the sheet drops onto a platform or stack formed thereon such that the top level of the stack is held constant relative to the abutment strips. These devices present problems if used with paper. For example, rebounding does not occur with thin stacks or individual sheets of paper. Moreover, an intricate and complicated device is required to keep the top level of the stack constant relative to the abutment strips.

U.S. Pat. No. 3,160,413 and British Patent Application No. 2,017,622 both describe a tray provided with an arched platform. In U.S. Pat. No. 3,160,413 a pair of fingers arches the sheets as they are fed upon the platform, thereby holding the sheets in integral contact with each other. British Patent Application No. 2,017,622 accomplishes the same result using guide rails. Because both devices hold the sheets in integral contact with each other, neither is well suited for neatly stacking bundles of sheets which are stapled together.

SUMMARY OF THE INVENTION

The present invention relates to a device for collecting sheets comprising a collecting tray having: a baseplate with an effective length in a first direction corresponding to a first sheet dimension, preferably the length; a wall plate, which adjoins a first edge of the baseplate at a right angle, the edge extending in a second direction, transversely of the first direction; the device also comprising at least one conveyor roller whose axis extends in a direction parallel to the first edge, the conveyor roller being situated at the side of the wall plate which is remote from the baseplate and being able to feed a sheet lying thereon in the direction of the baseplate; and an abutment strip provided at a second edge of the baseplate which is parallel to the first edge wherein the surface of the abutment strip facing the conveyor roller forms part of a cylindrical surface whose centerline coincides with the centerline of the conveyor roller and wherein the shortest distance between the conveyor roller circumference and the second edge equals a first sheet dimension, preferably the length.

In the above-described device, each sheet will be driven into the collecting tray in the direction of the baseplate (i.e. the first direction) by the conveyor roller almost until the leading edge of the sheet abuts the abutment strip. This ensures that the sheets form an orderly pile in the collecting tray. Another advantageous result of this device is that a bundle of sheets can be fed as a unit into the collecting tray without entraining the topmost sheets in the tray. In a typical collecting tray, the considerable relative weight of the bundle would disturb the order of the pile in the tray.

The present invention also provides that the first edge forms the lowest point of the baseplate enabling the sheets to slide down into contact with the wall plate. Furthermore, the abutting surface of the wall plate facing the abutment strip forms part of a cylindrical surface whose centerline coincides with the second edge of the baseplate. Consequently, the sheets are satisfactorily contained in the collecting tray between the wall plate and the abutment strip with minimal freedom of movement, thereby maintaining an orderly pile of sheets.

A further object of the present invention is to provide a device wherein bundles of sheets stapled together in one corner can be collected without disturbing the order of sheets or bundles of sheets in the collecting tray. This object is obtained by making the middle part of the baseplate higher than the side parts of the baseplate when viewed in a second direction transverse to the first direction. The effect of this is that the sheets in the collecting tray assume a curved shape so that a sheet or a bundle of sheets introduced into the tray comes into contact with a loose sheet or stapled bundle already in the tray only in the middle part. Thus, the sheet or bundle introduced can readily slide on as far as the abutment strip without colliding with a staple that may be present in the top sheet of the pile already in the collecting tray.

The invention and its advantages will be apparent from the following detailed description and with reference to the accompanying drawings.

BRIEF DESCRIPTION OF THE DRAWINGS

FIGS. 1 to 4 show a collecting tray 1 secured to a sheet processing device such as a copying machine. The sheet discharge section of the copier is represented by the numeral 2. Conveyor rollers 3 are mounted rotatably in sheet discharge section 2. Rollers 3 can be driven by any of a number of known means (not shown). Freely rotatable rollers 4 are mounted in sheet discharge section 2 on either side of conveyor rollers 3. The axis of rotation of rollers 4 is parallel to the axis of rotation of rollers 3.

The plane passing through the axes of rotation of rollers 3 and 4 forms an angle of 25° with a vertical plane such that sheets discharged between rollers 3 and 4 are delivered obliquely upwards. The distance between these axes of rotation is less than half the sum of the diameters of rollers 3 and 4. A sheet fed between these rollers is thus corrugated and acquires a greater stiffness in the direction of discharge so that the sheet portion projecting past rollers 3 and 4 does not immediately bend down under its own weight but continues to move obliquely upwards for a relatively long time. Rollers 4 are moveable vertically and can be lifted by sheets fed between rollers 3 and 4 which already have sufficient stiffness, thereby subjecting these sheets to less corrugation.

Collecting tray 1 consists of a baseplate 6 and a wall plate 7 which form a fixed unit which is connected to the sheet processing machine in a known manner (not shown). Wall plate 7 extends down from conveyor rollers 3 for a distance corresponding to the height of the pile of sheets that can be collected in the device.

Figure 2:
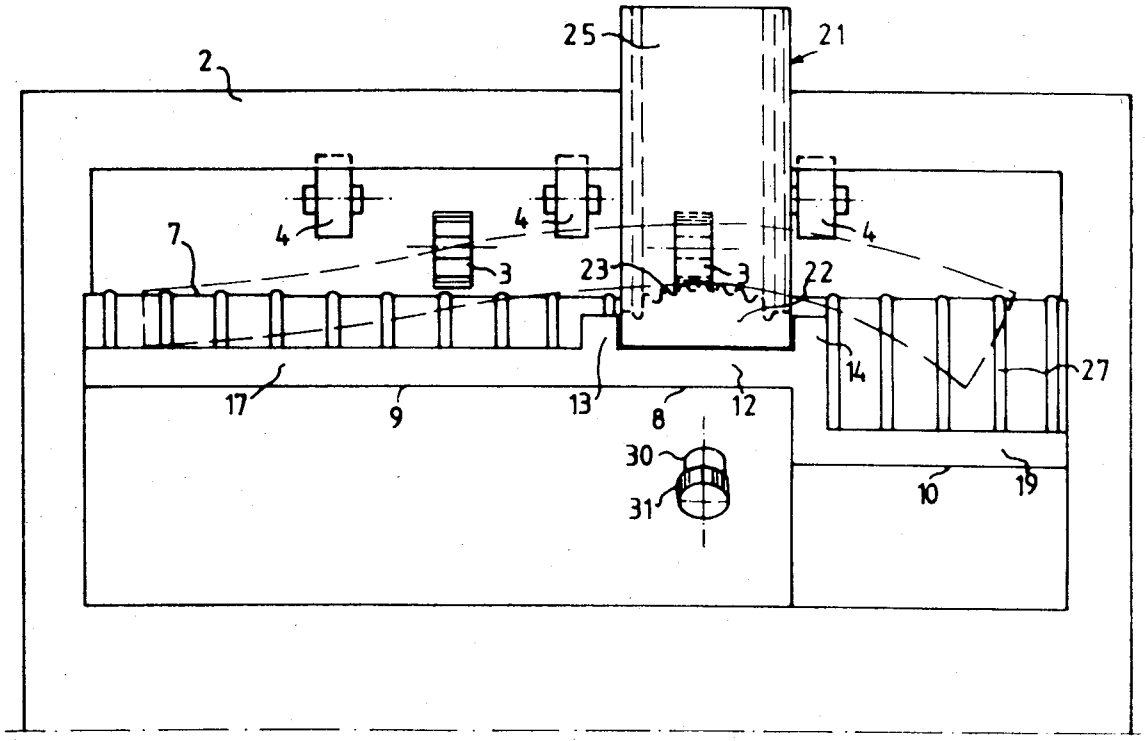
FIG. 2 is an end view of a collecting device according to the invention.
Figure 3:
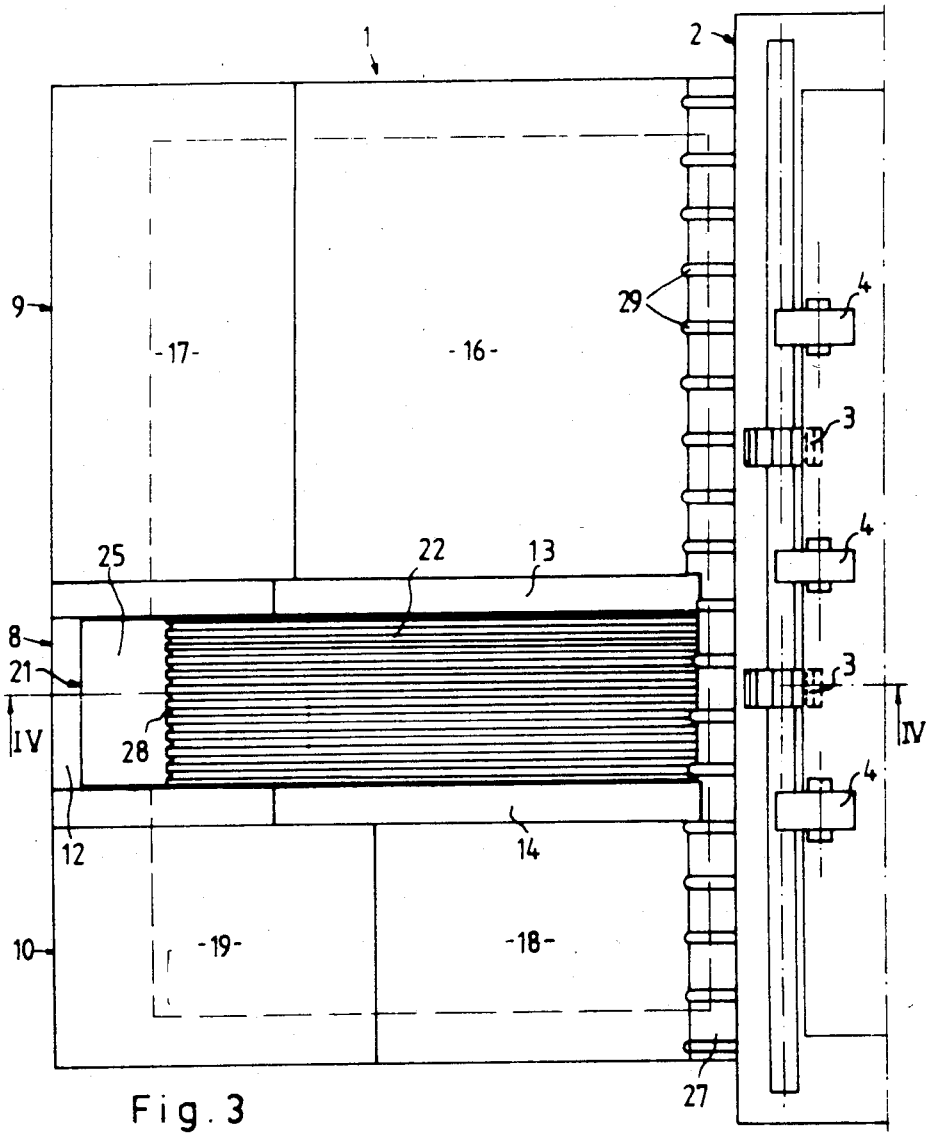
FIG. 3 is a top plan view of a collecting device according to the invention.

As shown in FIGS. 2 and 3, baseplate 6 consists of three parts, a middle part 8 and two side parts 9 and 10, respectively, situated next to one another transversely of the direction of sheet discharge from rollers 3 and 4. Middle part 8 of baseplate 6 extends from sheet discharge section 2 obliquely upwards over a lower portion 11 at an angle of 25° from the horizontal and then horizontally over an upper portion 12. Middle part 8 is bounded on either side by upright edges 13 and 14.

Side part 9 of baseplate 6 extends obliquely upwards from sheet discharge section 2 at an angle of 25° from the horizontal over a lower portion 16 and then horizontally over an upper portion 17. Side part 10 of baseplate 6 extends obliquely upwards from sheet discharge section 2 at an angle of 20° from the horizontal over a lower portion 18 and then horizontally over an upper portion 19. Portion 18 is shorter than portions 11 and 16, and portion 19 is lower than portions 12 and 17.

Figure 1:
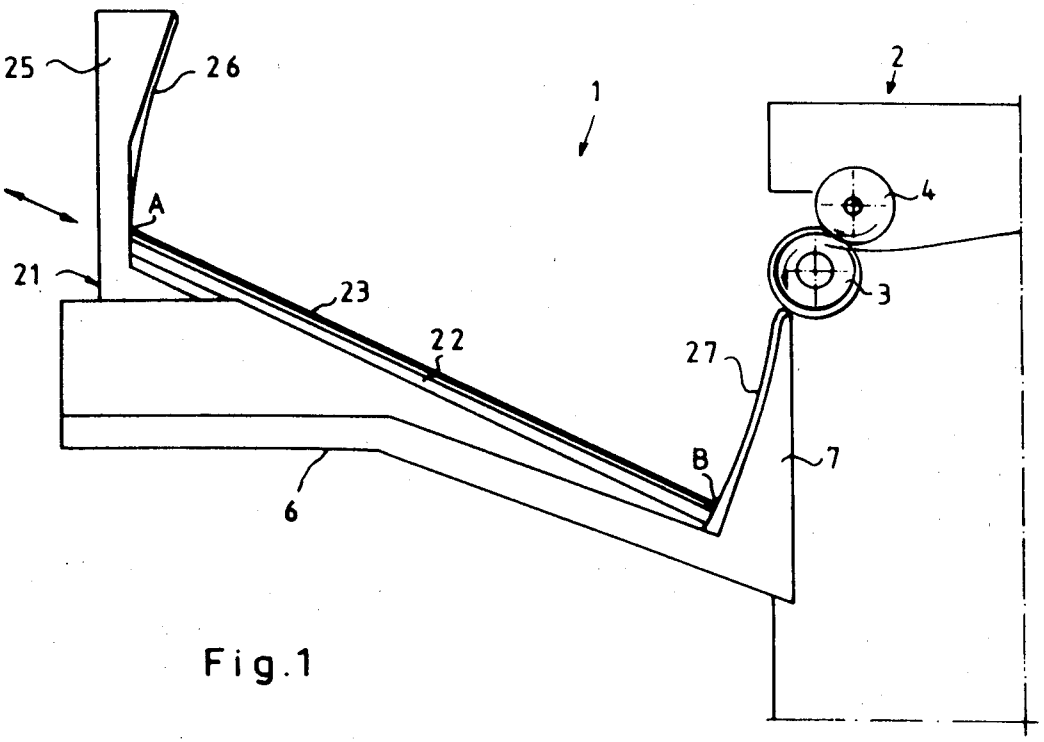
FIG. 1 is a side view of a collecting device according to the invention.
Figure 4:
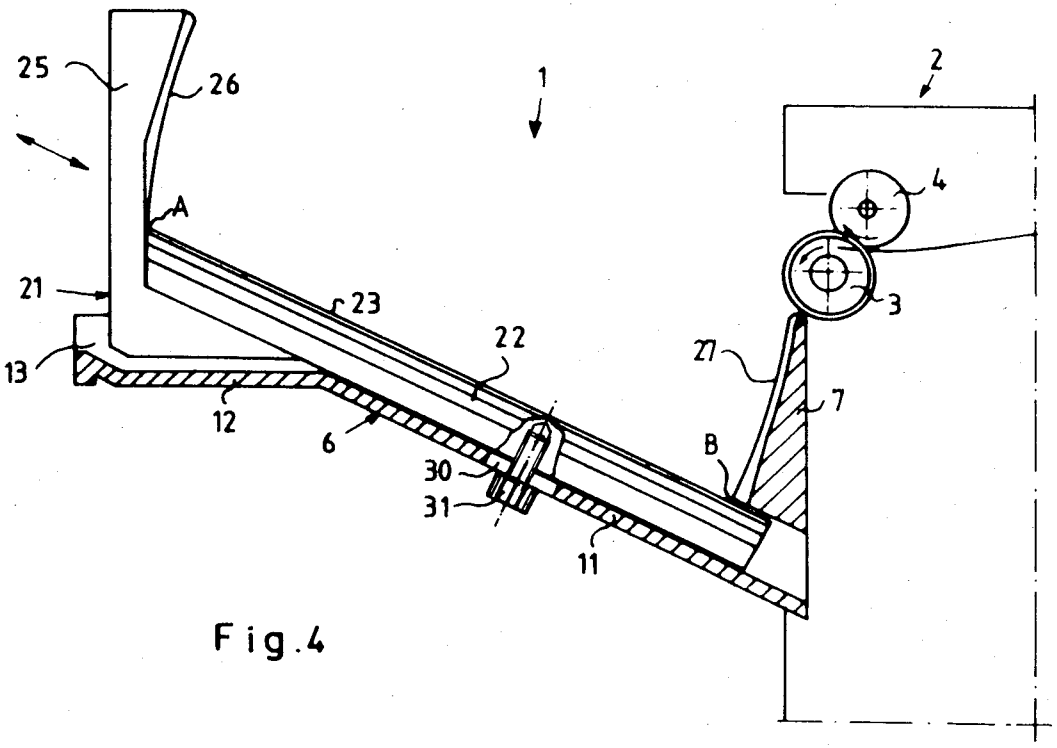
FIG. 4 is a view of a section taken along line IV—IV in FIG. 3.

Collecting tray 1 is provided with a slider 21 between upright edges 13 and 14. Slider 21 can be slid to and fro over oblique portion 11 in the direction indicated by the arrows in FIGS. 1 and 4. Slider 21 consists of a bottom part 22 having a surface 23 which is straight in the longitudinal direction and spherical in a direction transverse to the longitudinal direction as shown in FIG. 2. Slider 21 also consists of an upright 25 which forms an abutment strip having an abutment surface 26 for collecting sheets, as will be explained hereinafter.

Upright 25 is of a width corresponding to the width of bottom part 22 and of a length corresponding to the height of the pile of sheets that can be collected in the device. Bottom part 22 of slider 21 has a length corresponding to the maximum length dimension of the sheets to be collected in the device. An elongated hole 30 is formed in oblique portion 11 of middle part 8. Slider 21 can be fixed on baseplate 6 by means of a screw 31 extending through elongated hole 30.

Slider 21 is fixed in a position such that the distance between the highest point A of the intersection of surface 23 with abutment surface 26 and the highest point B of the intersection of surface 23 with wall part 7 corresponds to a dimension of the sheets to be collected in the device, preferably the length which is typically between 203 and 216 mm. Abutment surface 26 is cylindrically curved. When slider 21 is in the position in which there is the maximum distance between A and B, the centerline of cylindrically curved abutment surface 26 coincides with the axis of rotation of conveyor rollers 3 and the radius of abutment surface 26 corresponds to the maximum distance between A and B plus the radius of conveyor roller 3.

Wall part 7 extends along the entire width of baseplate 6. Surface 27 of wall part 7 forms an abutment surface for the rear edges of the sheets to be collected in the device. Surface 27 adjoins bottom part 22 of slider 21 at a right angle. Like abutment surface 26, abutment surface 27 is also cylindrically curved such that the centerline of cylindrically curved abutment surface 27 passes through point A when slider 21 is in its maximum position corresponding to the largest sheet size that can be collected in the device. In this position, cylindrically curved abutment surface 27 has a radius corresponding to a maximum sheet dimension, preferably the length. As shown in FIG. 3, slider 21 is provided with grooves 28 which extend in the longitudinal direction over spherical surface 23 of bottom part 22 and over abutment surface 26 of upright 25. Similarly, wall part 7 is also provided with grooves 29.

The collecting device of the present invention operates as follows. Sheets are discharged from the sheet processing machine by rollers 3 and 4. This discharge may comprise a single sheet, a bundle of loose sheets or a bundle of stapled sheets. The staple is provided by the sheet processing machine in a corner part of the bundle which, when viewed in the top plan view of FIG. 3, comes into a position at the bottom left in collecting tray 1. The position of the staple, as shown in FIG. 3, is indicated by the line in part 19.

Slider 21 is set to the length dimension of the sheets discharged from the processing machine. Rollers 3 and 4 are so situated with respect to one another that if collecting tray 1 is empty, the stiffest sheet or stiffest bundle of sheets discharged from the sheet processing machine sags just sufficiently for it still to come into contact with the upper portion of surface 23 of slider 21 before the rear end of the sheet or bundle is no longer engaged by rollers 3 and 4. For the sake of convenience, in the subsequent description of the operation of the device, it will be assumed that stapled bundles of sheets are being collected, although the description also applies to nonstapled bundles and individual sheets.

As a result of the speed of the bundle and/or because the rear edge of the bundle slides down along the circumference of rollers 3 and is pushed further on in the forward direction by these rollers, the front edge of the bundle will advance even after the bundle has come into contact with surface 23. The bundle will advance until it abuts abutment surface 26. At that moment, the rear edge of the bundle comes free of the circumference of rollers 3 and slides down along abutment surface 27. During this sliding movement, point A acts, as it were, as a pivot for the bundle. At the end of this sliding movement, the bundle rests over its entire length on surface 23 of slider 21 and the bundle is contained between abutment surfaces 26 and 27 so as to be free of any play.

Simultaneously with or subsequent to the sliding movement of the bundle, the side edges of the bundle move further down until, at the utmost, they abut side parts 9 and 10 of baseplate 6. Since portions 18 and 19 of side part 10 are lower than portions 16 and 17 of side part 9, the bundle can sag further on the side of side part 10. The asymmetrical location of middle part 8 ensures that the bundle is balanced despite the difference in the bundle sag and cannot slide from baseplate 6 in the direction of side part 10. The corner part of the bundle in which the staple is situated can sage the furthest with respect to a laterally horizontal plane touching surface 23 of slider 21.

Subsequent bundles of sheets, or individual sheets, are deposited in the device in the manner described hereinbefore, the only difference being that these bundles of sheets slide over the topmost previously deposited sheet as far as abutment surface 26. Since the previously deposited sheets are contained between abutments 26 and 27, they hardly can slide, and since any previously deposited bundle sags considerably, a sheet which is kept relatively flat and is still moving forward cannot collide with a staple present in a previously deposited bundle, which might interfere with the orientation of the sheets in collecting tray 1.

Horizontal portion 19 of side part 10 is situated at a height such that it is an easy matter to introduce one's hand between portion 19 and the part of the deposited pile of sheets (represented by broken lines in FIGS. 2 and 3) hanging down over portion 19 in order to grasp and remove the pile of sheets from collecting tray 1.

For the purpose of forming a pile of sheets consisting of bundles of sheets which are offset from one another in a transverse direction with respect to the direction of discharge, collecting tray 1 can be moved transversely over a short distance by any number of known means (not shown) prior to the discharge of a bundle.

Although the invention has been described in terms of an embodiment wherein the first direction is the length of the sheets to be collected and the second direction is the width, it can equally be embodied in a device wherein the first direction is the width of the sheets to be collected and the second direction is the length.

While presently preferred embodiments of the invention have been described and shown in the drawings with particularity, the invention may be otherwise embodied within the scope of the appended claims.

What is claimed is:

1. A device for collecting sheets comprising a collecting tray having: a baseplate with an effective length in a first direction corresponding to a first sheet dimension; a wall plate which adjoins a first edge of the baseplate at a right angle, the edge extending in a second direction transversely of the first direction; the device also comprising at least one conveyor roller whose axis extends in a direction parallel to the first edge, the conveyor roller being situated at the side of the wall plate which is remote from the baseplate and being able to feed a sheet lying thereon in the direction of the baseplate; and an abutment strip provided at a second edge of the baseplate which is parallel to the first edge wherein the surface of the abutment strip facing the conveyor roller forms part of a cylindrical surface whose centerline coincides with the centerline of the conveyor roller and wherein the shortest distance between the conveyor roller circumference and the second edge equals the first sheet dimension.

2. A device as described in claim 1 in which the first edge forms the lowest part of the baseplate and the wall plate has an abutment surface which forms part of a cylindrical surface whose centerline coincides with the second edge.

3. A device as described in claim 2 wherein at least part of the baseplate forms an angle of from 10° to 50° with a horizontal plane.

4. A device as described in claim 3 wherein the middle part of the baseplate is higher than the side parts of the baseplate.

5. A device as described in claim 4 wherein one of the side parts is lower than the other side part.

6. A device as described in claim 5 wherein the lower side part is shorter than the higher side part.

7. A device as described in claim 1 wherein the middle part of the baseplate is higher than the side parts of the baseplate.

8. A device as described in claim 7 wherein one of the side parts is lower than the other side part.

9. A device as described in claim 8 wherein the lower side part is shorter than the higher side part.

10. A device as described in claim 5 wherein a lower portion of the lower side part of the baseplate at the adjoining wall plate forms a smaller angle with a horizontal plane than lower portions of the other parts of the baseplate.

11. A device as described in claim 10 wherein a higher portion of each of the side parts extends horizontally.

12. A device as described in claim 11 wherein the horizontal portion of the lower side part is longer than the horizontal portion of the higher side part.

13. A device as described in claim 8 wherein a lower portion of the lower side part of the baseplate at the adjoining wall plate forms a smaller angle with a horizontal plane than lower portions of the other parts of the baseplate.

14. A device as described in claim 13 wherein a higher portion of each of the side parts extends horizontally.

15. A device as described in claim 14 wherein the horizontal portion of the lower side part is longer than the horizontal portion of the higher side part.

16. A device as claimed in claim 4 wherein the middle part of the baseplate and the abutment strip form a unit which is adjustable in the first direction with respect to the rest of the baseplate.

17. A device as described in claim 16 wherein the abutment strip extends only along the middle part of the baseplate.